United States Patent [19]

Williams

[11] 4,185,355

[45] Jan. 29, 1980

[54] APPARATUS FOR CLEANING UP ANIMAL FECES DEPOSITS

[76] Inventor: Robert W. Williams, 429 Cedar St., Lansdale, Pa. 19446

[21] Appl. No.: 855,968

[22] Filed: Nov. 30, 1977

[51] Int. Cl.[2] ..... A47L 5/24

[52] U.S. Cl. ..... 15/344; 15/347

[58] Field of Search ..... 15/344, 347, 415

[56] References Cited

U.S. PATENT DOCUMENTS

| | | | |
|---|---|---|---|
| 2,729,303 | 1/1956 | McMahan | 15/344 X |
| 3,477,087 | 11/1969 | Robinson | 15/344 |
| 4,011,624 | 3/1977 | Proett | 15/415 R X |

FOREIGN PATENT DOCUMENTS

| | | | |
|---|---|---|---|
| 598749 | 10/1959 | Italy | 15/344 |
| 984685 | 3/1965 | United Kingdom | 15/344 |

*Primary Examiner*—Edward L. Roberts

*Attorney, Agent, or Firm*—Joseph W. Molasky & Associates

[57] ABSTRACT

A method and apparatus for cleaning up an animal feces deposit from its situs by positioning an open-ended receptacle with its open end overlying and in close proximity to the animal feces deposit and providing a suction to pick up the animal feces deposit and deliver same into the interior of the receptacle whereby the receptacle containing the picked up animal feces deposit can be discarded conveniently and cleaning up has been achieved without any physical contact with the animal feces deposit by the person performing the cleaning up.

4 Claims, 5 Drawing Figures

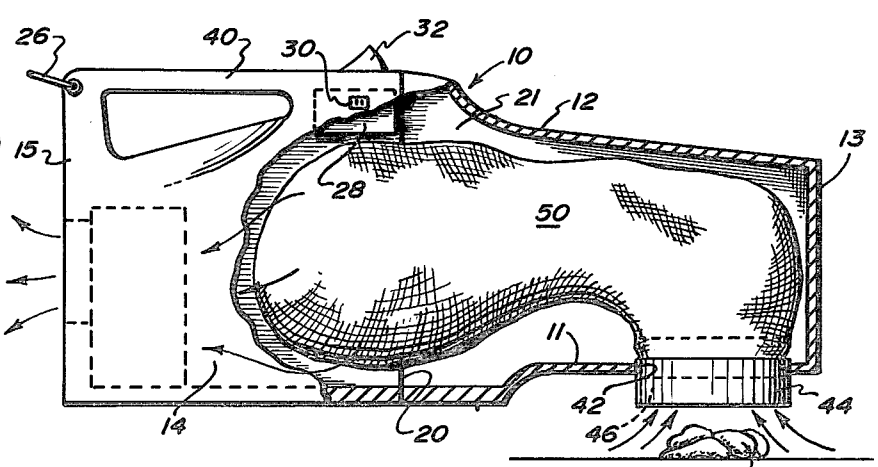
FIG. 2
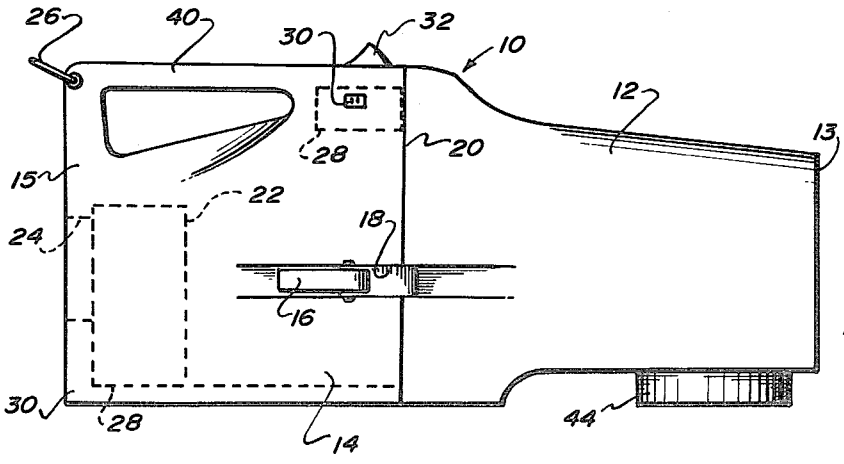
FIG. 1
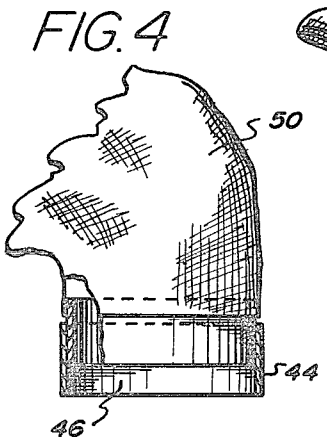
FIG. 4
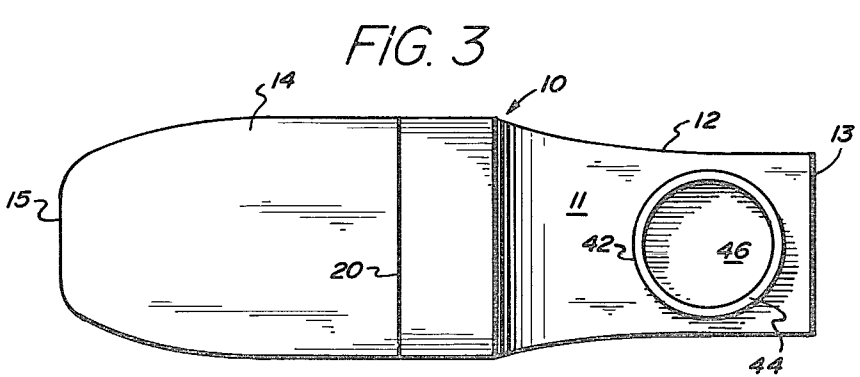
FIG. 3
FIG. 5

APPARATUS FOR CLEANING UP ANIMAL FECES DEPOSITS

BACKGROUND AND SUMMARY OF THE INVENTION

Household pets and other animals create a significant problem because they deficate instinctively, particularly outdoors where they show no regard for location or property.

This creates a serious problem for both pet owners and property owners who must tend to the removal of the animal feces deposits. Furthermore, there is the cost to municipalities of maintaining playgrounds, parks and the like in a sanitary and appealing condition. The expense and man-hours required to clean up animal feces deposits is substantial. Large urban areas have a more serious problem in this regard.

Furthermore, animal feces abounds with bacteria, including worms which can be transmitted to humans. This bacteria can cause diseases which affect adults and children alike, although children are particularly susceptibe because they sometimes unknowingly come into contact with such fecal matter and fail to cleanse themselves in a proper manner. This results in illnesses and diseases which are often costly and difficult to detect and cure.

This invention relates to a novel method and apparatus for cleaning up animal feces deposits from their situs without any physical contact with the animal feces deposit by the person performing the cleaning up.

Briefly stated, the apparatus in accordance with the invention comprises a casing adapted to be held in a clean-up position, nozzle means forming an opening in the bottom of the casing when the casing is held in the clean-up position, an open-ended receptacle positioned within the casing with its open end in communication with the bottom opening of the nozzle means, and suction producing means mounted in the casing for causing an air flow to create a suction at the bottom opening sufficient to pick up an animal feces deposit from its situs and cause the same to move into the interior of the receptacle when the casing is held in the clean-up position with the bottom opening in close proximity to the animal feces deposit to be cleaned up.

The inventive method and apparatus for cleaning up animal feces deposits have several important advantageous features. Physical contact with animal feces deposit is avoided completely and visual observation thereof is reduced to a minimum whereby the person performing the cleaning up is spared the two most odious aspects of the task and is protected against the inherent health hazards of the task. Also, the cleaning up is performed in a minimum of time resulting in the saving of much labor over a period of time.

BRIEF DESCRIPTION OF THE DRAWINGS

FIG. 1 is a side elevation of an apparatus according to the invention;

FIG. 2 is a view illustrating the method in accordance with the invention;

FIG. 3 is a bottom view of the apparatus shown in FIG. 1;

FIG. 4 is a fragmentary view showing a disposable nozzle-bag arrangement in accordance with the invention; and FIG. 5 is a fragmentary view showing a washable nozzle-bag arrangement in accordance with the invention.

DETAILED DESCRIPTION OF THE PREFERRED EMBODIMENTS OF THE INVENTION

The apparatus in accordance with the invention comprises a casing 10 comprised of two separable casing parts 12 and 14 held together by a pair of releasable clips 16 received in recesses 18 on opposite sides of casing 10. Clips 16 are mounted on casing part 14 and releasably engage a hook on casing part 12 as is conventional in the art. The casing parts 12 and 14 are closed at ends 13 and 15, respectively, and mate at a generally rectangular joint 20 as is apparent from a consideration of the drawings. Casing parts 12 and 14 are separable at joint 20 to permit access to the interior thereof through the open ends of the casing parts 12 and 14 enclosed by joint 20. When joined together, casing parts 12 and 14 define an internal chamber 21 therein as shown in FIG. 2.

Mounted within casing part 14 is an electrically operable, motor driven fan 22 constructed and arranged to cause air to flow from internal chamber 21 to the exterior of casing 10 by way of an air discharge port 24 in end 15 of casing part 14. Fan 22 is driven by a small high-speed universal motor operable on either alternating current or direct current. Fan 22 has a large number of blades set at an angle so that rotation thereof sets up a flow of air in an axial direction through fan 22 as shown by the arrows in FIG. 2.

Power for operating fan 22 is provided through either an electrical line in the form of an extension cord 26 adapted to be connected to a conventional household power supply or through a rechargeable battery 28 mounted in casing part 14. Rechargeable battery 28 is provided with a receptacle 30 for use in recharging the same.

A manually operable switch 32 is mounted on the top of casing part 14 and is operable between three control positions for controlling the operation of fan 22. Thus, switch 32 is positionable in an "OFF" position wherein no power is supplied to fan 22, a first "ON" position in which the rechargeable battery 28 is connected to operate fan 22, and a second "ON" position in which fan 22 is operated through cord 26.

Casing part 14 is provided with a handle 40 formed integrally therein at the top portion thereof. Handle 40 provides a convenient grip whereby casing 10 and the parts contained therein can be carried by the user of the apparatus thereby making the apparatus portable.

Casing part 12 is provided with a circular opening 42 in a bottom portion 11 thereof. Opening 42 is adapted to receive and hold a nozzle means in the form of circular tube 44 which is removably engaged within opening 42 by means of a press fit. The parts are constructed so that tube 44 may be inserted into opening 42 from the exterior of casing part 12 to achieve a press fit type of frictional engagement in bottom portion 11. Tube 44 is disengaged from bottom portion 11 by withdrawing tube 44 from its frictional engagement. Tube 44 serves as a nozzle means providing a bottom opening 46 in casing 10.

A receptacle in the form of an open-ended paper bag 50 has its open end secured to tube 44 by a suitable adhesive attachment as is shown in FIG. 4. Tube 44 is constructed of a paperboard type of material or some other disposable material. Bag 50 is made of paper or some other material that is pervious to the flow of air and is disposable. Bag 50 and tube 44 form a disposable nozzle-bag unit removably secured to casing 10 at bottom portion 11.

In FIG. 5 there is shown a washable nozzle-bag arrangement comprising a bag 52 of the same type as bag 50 and a tubular member 54 made of a washable material such as a sturdy plastic (a synthetic resin, for example) or rubber or the like. The lower portion of tubular member 54 is adapted to engage opening 42 with a press fit. The top end of tubular 54 is formed of a reduced diameter portion 56 provided with a circumferential recess 58. The open end of bag 52 is adapted to be removably secured onto tubular member 54 by means of an elastic band 59 adapted to be received in recess 58 as is shown in FIG. 5. Tube 55 serves as a nozzle means providing a bottom opening 55.

The bottom openings 46 and 66 provided by the nozzle forming tubes 44 and 54 are made of a large size sufficient to enclose the maximum typical animal feces deposit likely to be encountered. Typically, bottom openings 46 and 55 have a diameter of about 6.5 inches.

The use of the apparatus in accordance with the invention is shown in FIG. 2 wherein an animal feces deposit 60 is shown being cleaned up from its situs on the ground without the person performing the cleaning up coming into contact therewith. One step in the clean-up procedure is to actuate switch 32 to an "ON" position whereby fan 22 is operated to discharge a powerful stream of air from chamber 11 through the rear end 15 of casing part 14 through discharge port 24. This sets up a powerful inflowing current of air which flows through the bottom opening 46 provided by tube 44, through the interior of bag 50 to the suction inlet of fan 22. This air flow creates a suction (vacuum pressure) in the region below the lower end of tube 44.

The person performing the cleaning up supports casing 10 by one hand at handle 40 and positions the casing 10 so that the receptacle provided by bag 50 and tube 44 is located with its open end 46 overlying and in close proximity to animal feces deposit 60 as is shown in FIG. 2 and lowers casing 10 until the suction is sufficient to pick up animal feces deposit will be carried by the air flow through the open end of the receptacle into the interior of bag 50. After the pick-up is complete, the use actuates switch 32 to an "OFF" position to terminate operation of fan 22.

The final step in the clean-up procedure is to remove bag 50 containing the animal feces deposit from the casing 10 and discard same in an appropriate location such as a trash can or the like. In the embodiment of the invention shown in FIG. 2, this step is accomplished by withdrawing the disposable unit consisting of tube 44 and the bag 50 attached thereto through the bottom opening 42 in casing part 12 and discharding and disposable unit containing the picked up animal feces deposit. When using the washable unit shown in FIG. 5, an alternate discarding procedure may be used wherein casing portions 12 and 14 are separated and bag 52 is removed through the separated open portion of casing part 12 by grasping the bag 52 near the open end thereof and pulling the bag 52 from its removable attachment on tubular member 54. The removed bag 52 is then discarded in an appropriate location such as a trash can or the like.

It will be apparent that the above-described method and apparatus can be used to clean up animal feces deposits without any physical contact and with a minimum of visual contact therewith by the person performing the clean-up procedure. While this is the essence of the invention, it will be apparent that various modifications may be made within the scope of the invention. For example, the apparatus may be made of such a size as to hold numerous deposits of animal feces. This design is particularly important to municipalities which may use the apparatus and method of this invention in maintaining sanitary conditions in park, playgrounds or the like.

In addition to the effectiveness, ease of operation and sanitary aspects of the method and apparatus of this invention, it is noted that the invention has the additional benefit of being able to remove the animal feces deposits from lawns or from around shrubbery without causing any damage thereto. The method and apparatus of the invention requires no scraping or sweeping and therefore minimizes the possibility of any physical damage to the lawn or shrubs.

The apparatus in accordance with the invention is designed to be portable so that the user thereof can use the apparatus at any desired location. To this end, casing parts 12 and 14 are made of a sturdy, lightweight plastic (a synthetic resin, for example) and the apparatus is designed to provide a very compact arrangement as is shown in FIGS. 1–3. The construction and arrangement of handle 40 also facilitates the portability of the apparatus of the invention as does the provision of rechargeable battery 28.

The fan 22 is selected to be a type having the proper air flow-suction characteristics to achieve the vacuum pick up of animal feces deposits as described above. Such fans are readily available in the art. It will be apparent that, in operation, as the lower end of tube 44 approaches the ground, the inflow area is reduced and the suction increases. As the suction increases, it will eventually reach the vacuum pressure sufficient to result in the pick up of animal feces deposit 60 as shown in FIG. 2.

What is claimed is:

1. Apparatus for cleaning up a deposit of animal feces from its situs without any physical touching of the animal feces deposit by the user of the apparatus, comprising a casing adapted to be held in a clean-up position, a disposable unit constructed and arranged such that any part of the animal feces deposit that would normally contact the apparatus as it is picked up comes into contact only with said disposable unit, said disposable unit being removable from said casing for disposal, said disposable unit including a bag portion pervious to the flow of air forming a receptacle within said casing for receiving and holding an animal feces deposit, and an intake portion extending through the wall of said casing and communicating with the interior of said bag portion to form an intake passage for the flow of outside air and an animal feces deposit into the interior of said bag portion, and suction producing means mounted within said casing for causing an air flow to create a suction at said intake passage sufficient to pick up an animal feces deposit from its situs and cause the same to move into the interior of said bag portion when said casing is held in a clean-up position with said intake passage in close proximity to an animal feces deposit to be cleaned up.

2. Apparatus according to claim 1, including an air discharge outlet formed in said casing, said suction producing means comprising an electrically operated fan arranged to cause air to flow from said intake passage, through said bag to said air discharge opening.

3. Apparatus according to claim 2 including a rechargable battery mounted in said casing and arranged to provide a power source for operating said fan.

4. Apparatus according to claim 1 wherein said intake portion comprises a tubular member made of a disposable paperboard type of material.

* * * * *